United States Patent [19]

White

[11] 4,387,748

[45] Jun. 14, 1983

[54] CAN FILLING NOZZLE HEAD

[76] Inventor: Hugh L. White, Rte. 3, Box 51, Warrenton, Mo. 63383

[21] Appl. No.: 316,218

[22] Filed: Oct. 29, 1981

[51] Int. Cl.[3] ..... B65B 3/04

[52] U.S. Cl. ..... 141/57; 141/286

[58] Field of Search ..... 141/285–310, 141/37–66, 311 R, 1–12

[56] References Cited

U.S. PATENT DOCUMENTS 2,867,247 1/1959 Aldridge ..... 141/286

*Primary Examiner*—Houston S. Bell, Jr.

*Attorney, Agent, or Firm*—Polster, Polster and Lucchesi

[57] ABSTRACT

In a high production can filling machine nozzle head, an annular nose, adapted to extend within a can to be filled, has a leading surface with an exterior chamfer convergent in a direction toward a can to be filled, a multiplicity of liquid passages extending through the nose and opening through the chamfered area of the leading surface, the passages communicating with the interior of a filler bowl, and provision is made for snifting of the can. The nozzle head is designed to accommodate cans of various standard opening sizes, without modification of the head.

10 Claims, 6 Drawing Figures

FIG. 1.
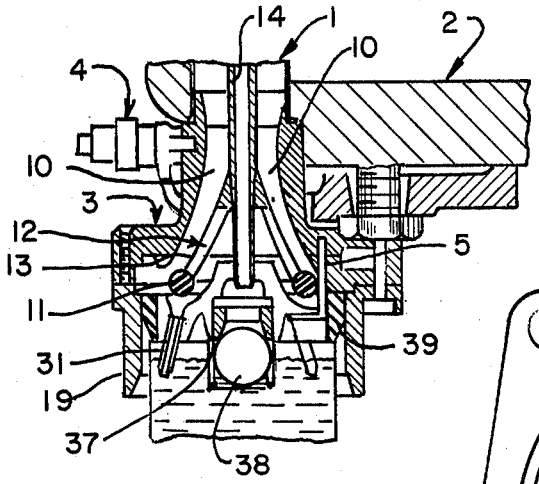
FIG. 2.
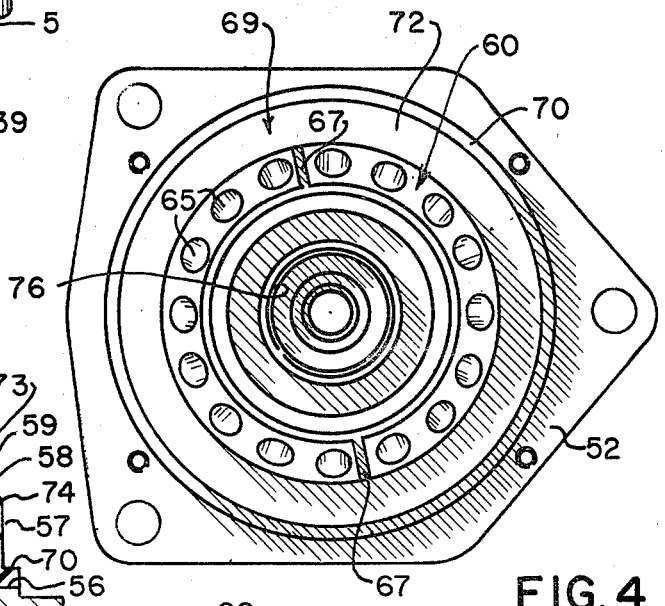
FIG. 3.
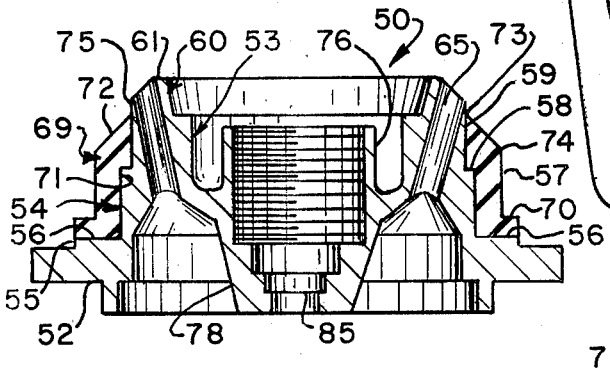
FIG. 4.
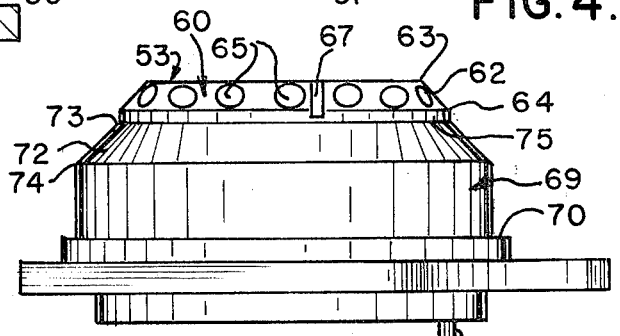
FIG. 5.
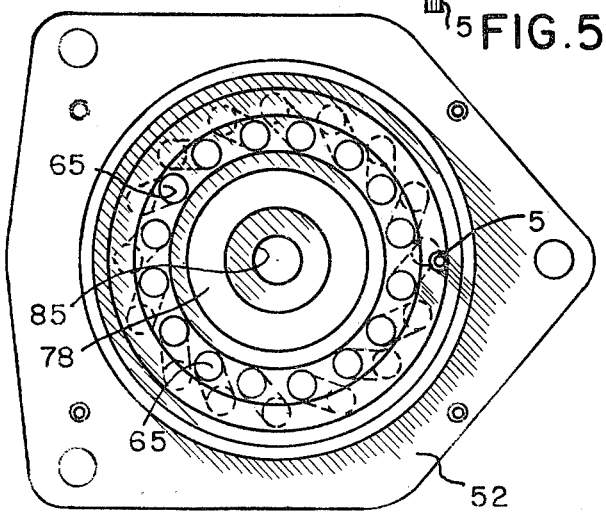
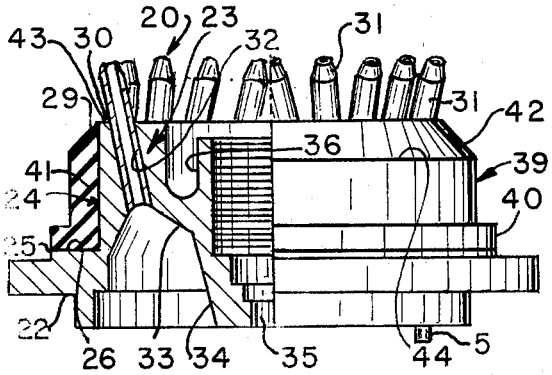
FIG. 6.
PRIOR ART

CAN FILLING NOZZLE HEAD

BACKGROUND OF THE INVENTION

The present invention will be described as applied to a 72-valve Can Filler sold by Geo. J. Meyer Manufacturing Co., of Cudahy, Wisconsin, described in detail in a manual identified as H P 341-1, 692C, copies of the cover and page 3-1 of which are filed herewith for reference, but the usefulness of the nozzle head of this invention is not confined to that machine. For example, with simple dimensional changes to accommodate different mounting arrangements, the nozzle head can be used on a Crown Cork and Seal Company machine, or other bowl type, gravity fill machines in which the nozzle head projects into head space above the liquid in the filled can.

High speed can filling machines for the canning of effervescent liquids such as carbonated soft drinks and beer, for example, have a multiplicity of "filling valves", frequently seventy-two, communicating with a filler bowl in which the liquid to be dispensed to the cans is maintained under pressure. The filling valves are equipped at their outer ends with nozzle heads, extending into the can to be filled. In conventional nozzle heads, the leading surface is perpendicular to the axis of the can to be filled, and a multiplicity of tubes, spaced evenly around the leading surface, project from the surface toward the side wall of the can to be filled, uniformly canted circumferentially and lying in an outwardly divergent conical projection.

There are two drawbacks to this construction. If a can is even slightly misaligned as it is raised to filling position, it can be dented or scratched by the end of a tube, and the present construction permits the filling of cans of only one opening size. As to the first, even a barely discernable scratch of the protective coating on the inside of a can will lead to the production of a metallic taste in the beverage. As to the second, because brewers and soft drink manufacturers have begun to use not only straight wall, but single, double and even triple necked cans, three and four different sets of valves have had to be used. At present prices, the replacement of a set of seventy-two valves amounts to a substantial investment.

One of the objects of this invention is to provide a filling machine nozzle head that obviates or minimizes damage to cans being filled.

Another object is to provide such a head that can be used without modification for filling cans with a multiplicity of opening sizes.

Still another object is to provide such a head that is relatively simple, inexpensive, easy to sanitize, minimizes product loss, and is rugged and dependable.

Other objects will become apparent to those skilled in the art in the light of the following description and accompanying drawing.

SUMMARY OF THE INVENTION

In accordance with this invention, generally stated, in a high production (generally in excess of 800 cans per minute) can filling machine, a nozzle head is provided that includes a nose adapted to extend within a can to be filled, the nose having a leading surface with an exterior chamfer, smooth with respect to the rim of a can to be filled, convergent in a direction toward the can to be filled, a multiplicity of liquid passages extending through the nose and opening through the chambered area of the leading surface, said passages communicating with the interior of a filler bowl, and means, preferably in the form of a diametric channel, for permitting snifting of the can. In the illustrative embodiment shown and described, the chamfer of the nose surface is about 45°, the liquid passages are linear and make an angle with the center line of the nose of about 10°, and their openings through the chamfered area lie within a circle with the center line of the nose as the center, with a diameter less than 2.2"; a sealing gasket surrounding a cylindrical side wall of the nozzle has a chamfered leading surface adjacent the trailing edge of the chamfered area of the nose, with diameters of less than 2.25" at its forward end and more than 2.6" at its trailing end.

BRIEF DESCRIPTION OF THE DRAWINGS

In the drawing,

FIG. 1 is a fragmentary sectional view of a bowl and one filling valve of a prior art commercial filling machine, in the process of filling a can;

FIG. 2 is a bottom plan view of one embodiment of nozzle head of this invention;

FIG. 3 is a diametric sectional view of the nozzle head of FIG. 2;

FIG. 4 is a view in side elevation of the nozzle head of FIGS. 2 and 3;

FIG. 5 is a top plan view of the nozzle head of FIGS. 2–4; and

FIG. 6 is a view, partly in section, of a prior art nozzle head.

DESCRIPTION OF THE PREFERRED EMBODIMENT

Referring now to FIG. 1 of the drawing, reference numeral 1 indicates a filling valve, mounted in a wall of a filler bowl 2. The filling valve 1 has a filling valve bonnet 3, on an outer wall of which a snift valve 4 is mounted. The snift valve 4 communicates with a snift tube 5. Passage 10 in the bonnet 3 communicates at one end with the interior of the bowl 2, and at another, with a plenum within the bonnet 3. An annular valve seat rubber 11 is held in position by a valve seat retainer 12, with arms 13 mounted securely on a valve stem 14. A valve nozzle insert or skirt 19 is mounted on a radial surface of the bonnet 3, surrounding, spaced from, and extending below a nozzle head 20, also mounted on the bonnet 3. All of these elements are standard, form no part of this invention, and are shown merely to facilitate the understanding of the invention by illustrating the environment in which it is used, the present invention having to do with an improvement in the nozzle head itself.

Referring to FIG. 6 for a detailed illustration of prior art nozzle head 20, reference numeral 22 indicates a mounting plate with which a body 23 is integral. The body 23 has a stepped cylindrical side wall 24, with a single step 25 immediately beyond the mounting plate 22, providing a radial support surface 26, and forward of it, i.e., in a direction toward a can to be filled, a straight cylindrical side wall part 29. The body has a flat radial leading surface 30, from which tubes 31 project. The tubes 31 are mounted in passages 32 which open at one end into a distributor channel-valve seat 33. The passages 32, hence the tubes 31, are uniformly spaced on a circle with the centerline of the body as its center, uniformly canted circumferentially (as best indicated in FIG. 5 in respect of the nozzle head of this invention), and tend radially outwardly on the projection of a cone with an angle from the centerline of about 10°. On the side of the distributor channel 33, and defining one wall of the channel, is a hub 34, through which a valve stem passage 35, enlarged intermediate its length to provide a gland, passes. On the other side of the body 23 is a liquid level cage boss 36, internally threaded to receive a threaded part of a liquid level cage 37, shown in FIG. 1, in which a ball float 38 is caged. A gasket 39, with a foot 40 resting upon the support surface 26, and an inner surface 41 complementary to the straight cylindrical surface part 29 of the body 23, fits tightly on the side wall 24 of the body. The gasket has at its forward end a chambered area 42 with a leading edge 43 terminating flush with the flat leading surface 30 of the body, and a trailing edge 44. The gasket is made of rubber or an equivalent resilient material.

Referring now to FIGS. 2, 3, 4 and 5, for the preferred embodiment of nozzle head of this invention, reference numeral 50 indicates the new head. The head 50 has a mounting plate 52 identical with the mounting head 22 of the prior art head shown in FIG. 6, because the head 50 is, in this illustrative embodiment, designed to replace the head 20 in a standard Meyer machine. The head 50 has a body 53, with a doubly stepped cylindrical side wall 54, including a first step 55, a support surface 56, an intermediate riser part 57, a second step 58 and an outer riser part 59. The head 50 has an annular nose 60, with a narrow flat radial leading surface 61 bounded at its outboard perimeter by the leading edge 63 of a forwardly convergent chamfer 62. A trailing edge 64 of the chamfer 62 marks the outer edge of the outer riser part of the cylindrical side wall 54.

Passages 65 extend through the body, communicating at one end with a distributor channel-valve seat 33, and opening through the surface of the chamfer 62. The chamfer 62 and leading surface 61 of the nose 60 are uninterrupted by any projection, and are smooth with respect to the rim of a can being filled, although they are cut by diametrically oriented snift channels 67, best shown in FIGS. 2 and 4.

A gasket 69, with a foot 70 resting upon the support surface 56, and a stepped inner surface complementary to the intermediate riser part 57, second step 58 and outer riser part 59 of the cylindrical side wall 54, is mounted tightly on the side wall. The gasket 69 has a chamfered area 72 at its forward end, with a sharp leading edge 73 and a trailing edge 74. The leading edge 73 of the gasket 69 ends short of the trailing edge 64 of the nozzle body chamfer 62, leaving a uniformly cylindrical surface 75 of the nose 60 projecting forwardly of the gasket 69.

The nozzle head 50, like the nozzle head 20, is provided with a liquid level cage boss 76 defining, with an inner side wall of the nozzle, an annular channel with which the snifter tube communicates, and a hub 78, through which a valve stem passage 85 with a gland extends.

The dimensions of the nozzle head of this invention are critical in the respects that the diameter of the nose at the outer riser surface 59 must be less than the inside diameter of the mouth of the can with the smallest mouth to be filled, and the diameter of the sealing gasket 69 at the trailing edge 74 of the chamfered area 72 must be greater than the diameter of the mouth of the can with the largest mouth to be filled. In the construction of the embodiment shown, in which the means for permitting snifting of the can after it is filled includes snift channels 67, it is also necessary that the projection of the leading surface 61 into the can be such with respect to the filling level of the can, that at least a portion of the snift channels remain above the level of the liquid when the can is filled, to ensure that all of the head space is snifted. Merely by way of example, conventionally the diameters of the mouths of straight wall, single necked and double necked cans are 2 11/16", 2 9/16" and 2 15/32", respectively. The nozzle head of this invention will accommodate all three sizes when the diameter of the nose at the outer riser part 59 is 2.25", the diameter of the nose at the leading edge 63 of the chamfer 62, 1.687", the chamfer angle between the trailing edge 64 and the leading edge 63, 45°, and the axial height of the nose between the leading edge 73 of the gasket 69 and the leading surface 61, 0.437". The projecting area 75 extends 0.0625" between the leading edge 73 of the gasket and the trailing edge 61 of the nose chamfer. The distance between the support surface 56 and the leading edge 73 of the gasket 69 is 0.875", and to the trailing edge 74, 0.604". The angle of the chamfer 72 between the trailing edge 74 and leading edge 73 is 45°, and the radial distance between the leading edge 73, which itself has no appreciable width, and the trailing edge, is 0.563", the diameter of the gasket at the trailing edge 74 being 2.750".

The snift channels 67 are 0.625" wide and 0.250" deep. The angle of the passages 65 in the direction toward the side wall of the can to be filled is 10°, and the diameter of the passages, 13/64" for filling speeds above 1200 cans per minute.

The height of the leading surface 61 of the nose from the support surface 56 is less than the height of the ends of the tubes 31 of the prior art nozzle from the support surface 26. The diameter of the circle within which the openings of the passages through the chamfer of the nose of this invention lie is smaller than the diameter of the circle within which the outer ends of the tubes of the prior art nozzle lie, and the diameter of the leading edge of the gasket 69 is also smaller than the diameter of the leading edge of the gasket 39 of the prior art nozzle, to which end, the second step 58 is important.

The nozzle head of this invention with these dimensions not only will accommodate all three conventional sizes of cans, but, because of the smooth surface of the chamfered surface of the nose, and the tolerance provided, will do so with no damage to the cans in the filling.

Numerous variations in the construction of the nozzle head of this invention, within the scope of the appended claims, will occur to those skilled in the art in the light of the foregoing disclosure. Merely by way of example, by decreasing by only a small amount the diameter of the circle within which the openings of the passages through the chamfered surface of the nose lie, and increasing the reach of the chamfered surface of the gasket accordingly, the nozzle head can be made to accommodate a triple necked can with a mouth opening of 2 5/16", and all other intermediate sizes to 2 11/16". The distance between the support surface 56 and the leading edge 73 of the gasket 69 can be varied to vary the fill height of the can and to accommodate different fill speeds, supplementing the adjustment of the liquid level cage. For example, it can be made 0.925" to increase the fill and to operate at speeds above 1200 cans per minute. The angle of the gasket chamfer can be varied, but the 45° angle of the preferred embodiment has been found to be especially desirable, serving not only to give good protection against mushrooming the rim of the can, but providing a self-adjusting gauge for filling cans of different mouth diameters. Snift channels 67 may be replaced by radial holes bored through the nose, and the mounting plate 52 can be changed to accommodate different machines. These are merely illustrative.

I claim:

1. In a high production can filling machine nozzle head, the improvement comprising an annular nose, adapted to extend within a can to be filled, said nose having a leading surface with an exterior, peripheral chamfer convergent in a direction toward a can to be filled, a multiplicity of liquid passages extending through the nose and opening at one end through said chamfered surface area of said leading surface, and communicating at another end with the interior of a filler bowl, and means for permitting snifting of the head space of said can.

2. The improvement of claim 1 wherein the means for permitting snifting of the head space of the can comprise channels extending diametrically across said leading surface between successive of said passages.

3. The improvement of claim 1 wherein the chamfer angle is approximately 45° with respect to the center line of said annular nose.

4. The improvement of claim 1 wherein the passages are linear and the passages tend away from the center line of said annular nose in the direction toward the can to be filled and the angle of the passages with respect to the chamfered leading surface of the nose is obtuse.

5. The improvement of claim 1 wherein the outer open mouths of the passages are within a circle with the center line of the nose as the center, of a diameter less than 2.20".

6. The improvement of claim 1 including a can sealing gasket mounted on and around a cylindrical side wall of said nose adjacent the trailing end of said chamfered leading surface of the nose, said gasket having a chamfered outer leading surface radially outboard of and axially trailing the outer open mouths of the passages.

7. The improvement of claim 6 wherein the diameter of the said nose at the trailing edge of its chamfered surface and the diameter of the chamfered leading surface of the sealing gasket at its forward end are less than the inside diameter of the mouth of the can with the smallest mouth of a plurality of cans with mouths of different sizes, and the diameter of the chamfered leading surface of the sealing gasket at its trailing end is greater than the outside diameter of the mouth of the can with the largest mouth of said plurality of cans.

8. The improvement of claim 7 wherein the diameter of the chamfered leading surface of the sealing gasket is less than 2.25" at its forward end and more than 2.6" at its trailing end.

9. The improvement of claim 7 wherein the angle of the chamfered leading surface of the sealing gasket with respect to the center line of said nozzle head is about 45°.

10. The improvement of claim 7 wherein the nozzle head has a doubly stepped cylindrical side wall bounded at its forward end by the chamfer of said nose, and said gasket has an interior wall stepped complementarily to the said side wall.

* * * * *